US006381964B1

(12) United States Patent
Pritchard, Jr. et al.

(10) Patent No.: US 6,381,964 B1
(45) Date of Patent: May 7, 2002

(54) MULTIPLE ANNULAR COMBUSTION CHAMBER SWIRLER HAVING ATOMIZING PILOT

(75) Inventors: Byron Andrew Pritchard, Jr., Loveland; Allen Michael Danis, Mason; Michael Jerome Foust, West Chester; Mark David Durbin, Springboro; Hukam Chand Mongia, West Chester, all of OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/675,664

(22) Filed: Sep. 29, 2000

(51) Int. Cl.[7] ..... F02G 3/00
(52) U.S. Cl. ..... 60/746; 60/748
(58) Field of Search ..... 60/746, 747, 748

(56) References Cited

U.S. PATENT DOCUMENTS

| | | | | |
|---|---|---|---|---|
| 2,551,276 A | | 5/1951 | McMahan | |
| 2,968,925 A | | 1/1961 | Blevans et al. | |
| 3,302,399 A | | 2/1967 | Tini et al. | |
| 3,474,970 A | | 10/1969 | Simmons et al. | |
| 3,630,024 A | | 12/1971 | Hopkins | |
| 3,638,865 A | | 2/1972 | McEneny et al. | |
| 3,899,884 A | | 8/1975 | Ekstedt | |
| 3,980,233 A | | 9/1976 | Simmons et al. | |
| 4,105,163 A | | 8/1978 | Davis, Jr. et al. | |
| 4,198,815 A | | 4/1980 | Bobo et al. | |
| 4,418,543 A | | 12/1983 | Faucher et al. | |
| 4,584,834 A | | 4/1986 | Koshoffer et al. | |
| 4,726,192 A | | 2/1988 | Willis et al. | |
| 4,974,416 A | | 12/1990 | Taylor | |
| 5,020,329 A | | 6/1991 | Ekstedt et al. | |
| 5,321,950 A | | 6/1994 | Shekleton et al. | |
| 5,435,884 A | | 7/1995 | Simmons et al. | |
| 5,540,056 A | | 7/1996 | Heberling et al. | |
| 5,623,827 A | * | 4/1997 | Monty | 60/748 |
| 5,647,215 A | * | 7/1997 | Sharifi et al. | 239/431 |
| 6,082,111 A | * | 7/2000 | Stokes | 60/737 |
| 6,141,967 A | * | 11/2000 | Angel et al. | 239/405 |
| 6,161,387 A | * | 12/2000 | Green | 60/742 |
| 6,301,899 B1 | * | 10/2001 | Dean et al. | 60/737 |

OTHER PUBLICATIONS

U.S. Patent application Ser. No. 60/176,379, filed Jan. 14, 2000, entitled, "Method and Apparatus for Decreasing Combustor Emissions."

U.S. Patent application Ser. No. 09/054,794, filed Apr. 3, 1998, entitled, "Anti–Carboning Fuel–Air Mixer for a Gas Turbine Engine Combustor."

* cited by examiner

*Primary Examiner*—Charles G. Freay
(74) *Attorney, Agent, or Firm*—William Scott Andes; David E. Crawford, Jr.

(57) ABSTRACT

A mixer assembly for use in a combustion chamber of a gas turbine engine. The assembly includes a pilot mixer and a main mixer. The pilot mixer includes an annular pilot housing having a hollow interior, a pilot fuel nozzle mounted in the housing adapted for dispensing droplets of fuel to the hollow interior of the pilot housing, and a plurality of concentrically mounted axial swirlers positioned upstream from the pilot fuel nozzle. Each of the swirlers has a plurality of vanes for swirling air traveling through the respective swirler to mix air and the droplets of fuel dispensed by the pilot fuel nozzle. The main mixer includes a main housing surrounding the pilot housing defining an annular cavity, a plurality of fuel injection ports for introducing fuel into the cavity, and a swirler positioned upstream from the plurality of fuel injection ports having a plurality of vanes for swirling air traveling through the swirler to mix air and the droplets of fuel dispensed by the fuel injection ports.

14 Claims, 4 Drawing Sheets

MULTIPLE ANNULAR COMBUSTION CHAMBER SWIRLER HAVING ATOMIZING PILOT

The United States government has rights in this invention under Contract No. NAS3-27720 awarded by the National Aeronautics & Space Administration.

BACKGROUND OF THE INVENTION

The present invention relates generally to gas turbine engine combustors, and more particularly to a combustor including a mixer having multiple injectors.

Fuel and air are mixed and burned in combustors of aircraft engines to heat flowpath gases. The combustors include an outer liner and an inner liner defining an annular combustion chamber in which the fuel and air are mixed and burned. A dome mounted at the upstream end of the combustion chamber includes mixers for mixing fuel and air. Ignitors mounted downstream from the mixers ignite the mixture so it burns in the combustion chamber.

Governmental agencies and industry organizations regulate the emission of nitrogen oxides (NOx), unburned hydrocarbons (HC), and carbon monoxide (CO) from aircraft. These emissions are formed in the combustors and generally fall into two classes, those formed due to high flame temperatures and those formed due to low flame temperatures. In order to minimize emissions, the reactants must be well mixed so that burning will occur evenly throughout the mixture without hot spots which increase NOx emissions or cold spots which increase CO and HC emissions. Thus, there is a need in the industry for combustors having improved mixing and reduced emissions.

Some prior art combustors such as rich dome combustors 10 as shown in FIG. 1 have mixers 12 which provide a rich fuel-to-air ratio adjacent an upstream end 14 of the combustor. Because additional air is added through dilution holes 16 in the combustor 10, the fuel-to-air ratio is lean at a downstream end 18 of a combustor opposite the upstream end 14. In order to improve engine efficiency and reduce fuel consumption, combustor designers have increased the operating pressure ratio of the gas turbine engines. However, as the operating pressure ratios increase, the combustor temperatures increase. Eventually the temperatures and pressures reach a threshold at which the fuel-air reaction occurs much faster than mixing. This results in local hot spots and increased NOx emissions.

Lean dome combustors 20 as shown in FIG. 2 have the potential to prevent local hot spots. These combustors 20 have two rows of mixers 22, 24 allowing the combustor to be tuned for operation at different conditions. The outer row of mixers 24 is designed to operate efficiently at idle conditions. At higher power settings such as takeoff and cruise, both rows of mixers 22, 24 are used, although the majority of fuel and air are supplied to the inner row of mixers. The inner mixers 22 are designed to operate most efficiently with lower NOx emissions at high power settings. Although the inner and outer mixers 22, 24 are optimally tuned, the regions between the mixers may have cold spots which produce increased HC and CO emissions.

SUMMARY OF THE INVENTION

Among the several features of the present invention may be noted the provision of a mixer assembly for use in a combustion chamber of a gas turbine engine. The assembly includes a pilot mixer and a main mixer. The pilot mixer includes an annular pilot housing having a hollow interior, a pilot fuel nozzle mounted in the housing adapted for dispensing droplets of fuel to the hollow interior of the pilot housing, and a plurality of concentrically mounted axial swirlers positioned upstream from the pilot fuel nozzle. Each of the swirlers has a plurality of vanes for swirling air traveling through the respective swirler to mix air and the droplets of fuel dispensed by the pilot fuel nozzle. The main mixer includes a main housing surrounding the pilot housing defining an annular cavity, a plurality of fuel injection ports for introducing fuel into the cavity, and a swirler positioned upstream from the plurality of fuel injection ports having a plurality of vanes for swirling air traveling through the swirler to mix air and the droplets of fuel dispensed by the fuel injection ports.

Other features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
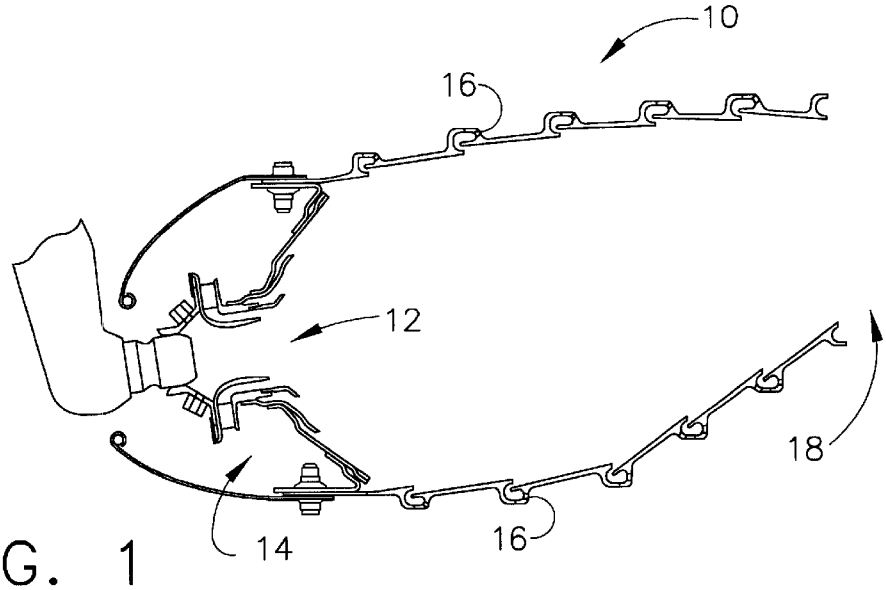
FIG. 1 (PRIOR ART)
FIG. 1 is a vertical cross section of an upper half of a conventional rich dome combustor.
Figure 2:
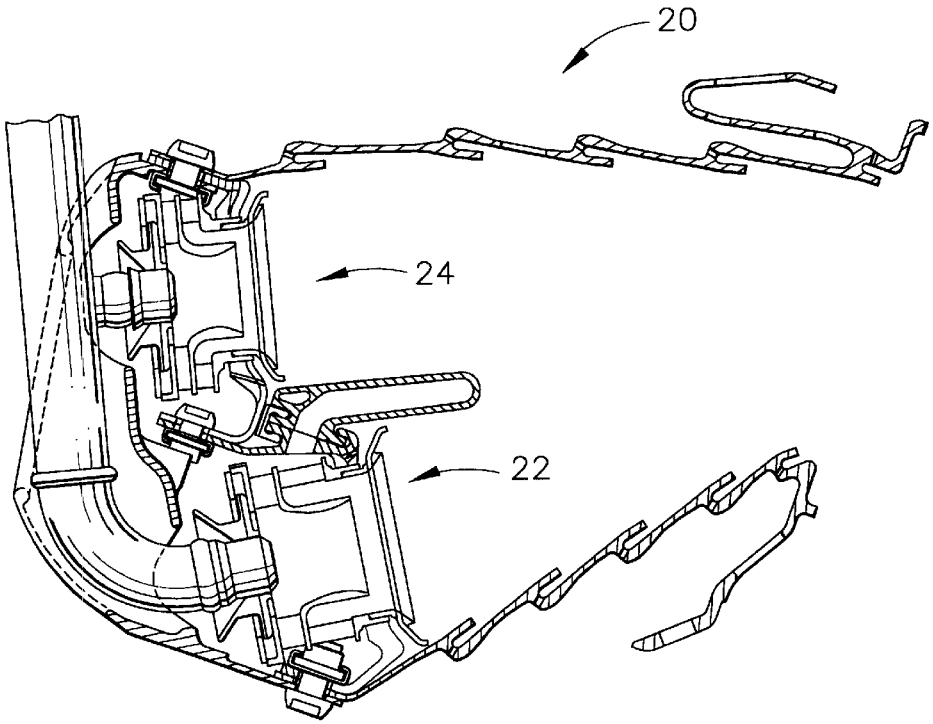
FIG. 2 (PRIOR ART)
FIG. 2 is a vertical cross section of an upper half of a conventional lean dome combustor.
Figure 3:
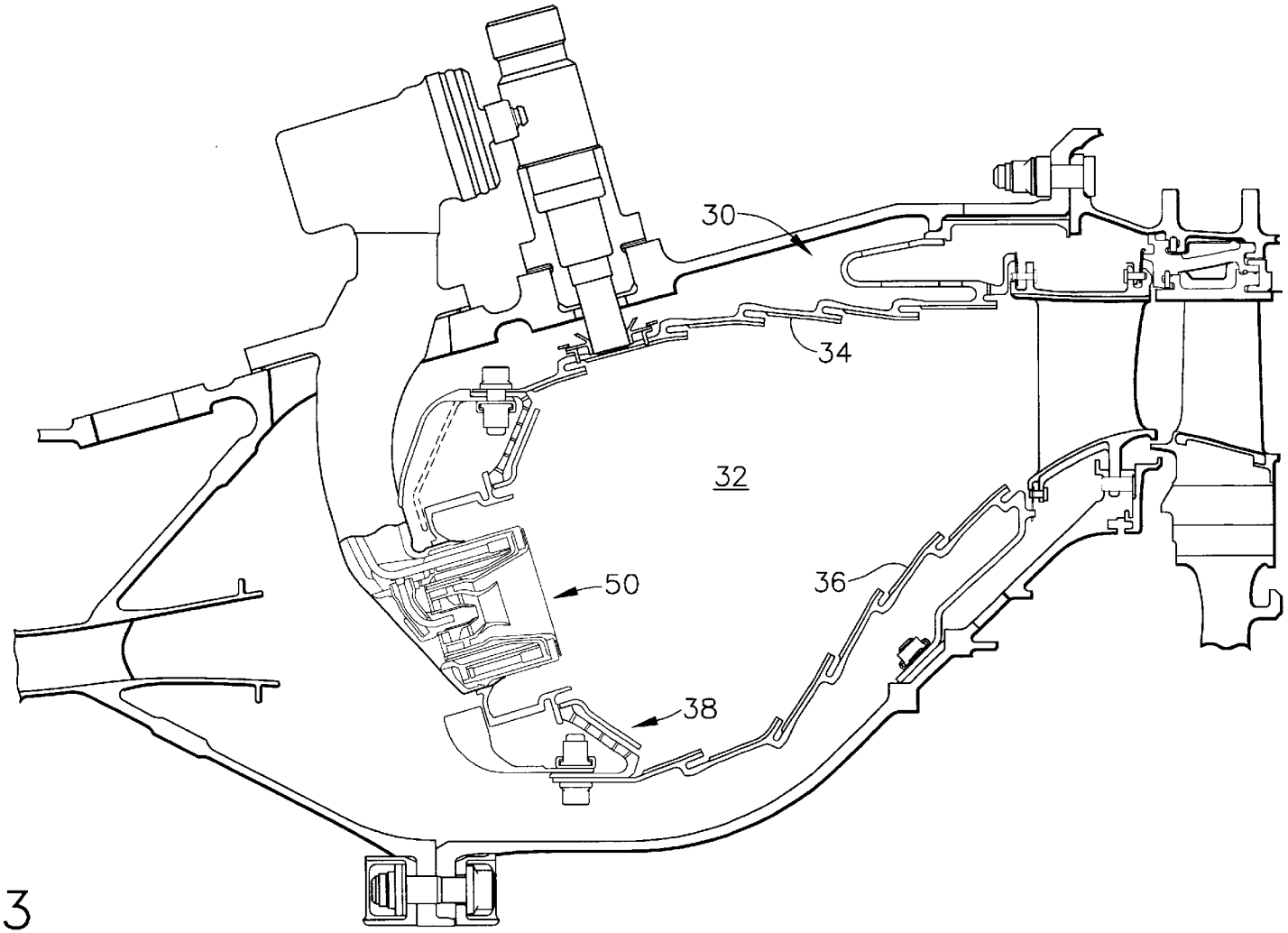
FIG. 3 is a vertical cross section of an upper half of a combustor of the present invention.

Referring to the drawings and in particular to FIG. 3, a combustor of the present invention is designated in its entirety by the reference number 30. The combustor 30 has a combustion chamber 32 in which combustor air is mixed with fuel and burned. The combustor 30 includes an outer liner 34 and an inner liner 36. The outer liner 34 defines an outer boundary of the combustion chamber 32, and the inner liner 36 defines an inner boundary of the combustion chamber. An annular dome, generally designated by 38, mounted upstream from the outer liner 34 and the inner liner 36 defines an upstream end of the combustion chamber 32. Mixer assemblies or mixers of the present invention, generally designated by 50, are positioned on the dome 38. The mixer assemblies 50 deliver a mixture of fuel and air to the combustion chamber 32. Other features of the combustion chamber 30 are conventional and will not be discussed in further detail.

Figure 4:
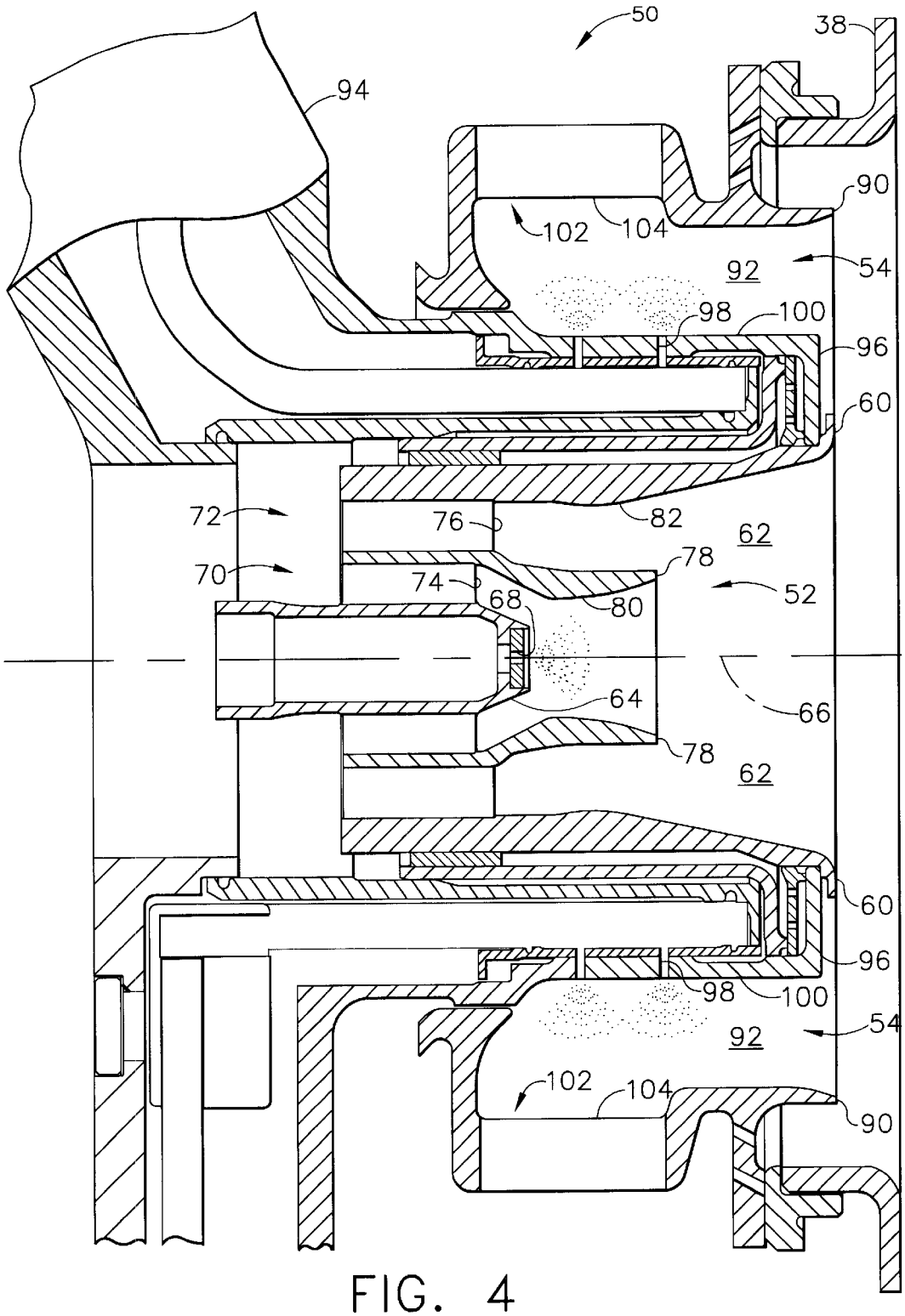
FIG. 4 is a vertical cross section of a mixer assembly of a first embodiment of the present invention.

As illustrated in FIG. 4, each mixer assembly 50 generally comprises a pilot mixer, generally designated by 52, and a main mixer, generally designated by 54, surrounding the pilot mixer. The pilot mixer 52 includes an annular pilot housing 60 having a hollow interior 62. A pilot fuel nozzle, generally designated by 64, is mounted in the housing 60 along a centerline 66 of the mixer 50. The nozzle 64 includes a fuel injector 68 adapted for dispensing droplets of fuel into the hollow interior 62 of the pilot housing 60. It is envisioned that the fuel injector 68 may include an injector such as described in U.S. Pat. No. 5,435,884, which is hereby incorporated by reference.

The pilot mixer 52 also includes a pair of concentrically mounted axial swirlers, generally designated by 70, 72, having a plurality of vanes 74, 76, respectively, positioned upstream from the pilot fuel nozzle 64. Although the swirlers 70, 72 may have different numbers of vanes 74, 76 without departing from the scope of the present invention, in one embodiment the inner pilot swirler has 10 vanes and the outer pilot swirler has 10 vanes. Each of the vanes 74, 76 is skewed relative to the centerline 66 of the mixer 50 for swirling air traveling through the pilot swirler 52 so it mixes with the droplets of fuel dispensed by the pilot fuel nozzle 64 to form a fuel-air mixture selected for optimal burning during ignition and low power settings of the engine. Although the pilot mixer 52 of the disclosed embodiment has two axial swirlers 70, 72, those skilled in the art will appreciate that the mixer may include more swirlers without departing from the scope of the present invention. As will further be appreciated by those skilled in the art, the swirlers 70, 72 may be configured alternatively to swirl air in the same direction or in opposite directions. Further, the pilot interior 62 may be sized and the pilot inner and outer swirler 70, 72 airflows and swirl angles may be selected to provide good ignition characteristics, lean stability and low CO and HC emissions at low power conditions.

A cylindrical barrier 78 is positioned between the swirlers 70, 72 for separating airflow traveling through the inner swirler 70 from that flowing through the outer swirler 72. The barrier 78 has a converging-diverging inner surface 80 which provides a fuel filming surface to aid in low power performance. Further, the housing 60 has, a generally diverging inner surface 82 adapted to provide controlled diffusion for mixing the pilot air with the main mixer airflow. The diffusion also reduces the axial velocities of air passing through the pilot mixer 52 and allows recirculation of hot gasses to stabilize the pilot flame.

The main mixer 54 includes a main housing 90 surrounding the pilot housing 60 and defining an annular cavity 92. A fuel manifold 94 having an annular housing 96 is mounted between the pilot housing 60 and the main housing 90. The manifold 94 has a plurality of fuel injection ports 98 on its exterior surface 100 for introducing fuel into the cavity 92 of the main mixer 54. Although the manifold 94 may have a different number of ports 98 without departing from the scope of the present invention, in one embodiment the manifold has a forward row consisting of 20 evenly spaced ports and an aft row consisting of 20 evenly spaced ports. Although the ports 98 are arranged in two circumferential rows in the embodiment shown in FIG. 4, those skilled in the art will appreciate that they may be arranged in other configurations without departing from the scope of the present invention. As will be understood by those skilled in the art, using two rows of fuel injector ports at different axial locations along the main mixer cavity provides flexibility to adjust the degree of fuel-air mixing to achieve low NOx and complete combustion under variable conditions. In addition, the large number of fuel injection ports in each row provides for good circumferential fuel-air mixing. Further, the different axial locations of the rows may be selected to prevent combustion instability.

By positioning the annular housing 96 of the fuel manifold 94 between the pilot mixer 52 and the main mixer 54, the mixers are physically separated. Further, the pilot housing 60 and fuel manifold 94 obstructs a clear line of sight between the pilot mixer fuel nozzle 64 and the main housing cavity 92. Thus, the pilot mixer 52 is sheltered from the main mixer 54 during pilot operation for improved pilot performance stability and efficiency and reduced CO and HC emissions. Further, the pilot housing 60 is shaped to permit complete burnout of the pilot fuel by controlling the diffusion and mixing of the pilot flame into the main mixer 54 airflow. As will also be appreciated by those skilled in the art, the distance between the pilot mixer 52 and the main mixer 54 may be selected to improve ignition characteristics, combustion stability at high and lower power and low CO and HC emissions at low power conditions.

The main mixer 54 also includes a swirler 102 positioned upstream from the plurality of fuel injection ports 98. Although the main swirler 102 may have other configurations without departing from the scope of the present invention, in one embodiment the main swirler is a radial swirler having a plurality of radially skewed vanes 104 for swirling air traveling through the swirler 102 to mix the air and the droplets of fuel dispensed by the ports 98 in the manifold housing 96 to form a fuel-air mixture selected for optimal burning during high power settings of the engine. Although the swirler 102 may have a different number of vanes 104 without departing from the scope of the present invention, in one embodiment the main swirler has 32 vanes. The main mixer 54 is primarily designed to achieve low NOx under high power conditions by operating with a lean air-fuel mixture and by maximizing the fuel and air pre-mixing. The radial swirler 102 of the main mixer 54 swirls the incoming air through the radial vanes 104 and establishes the basic flow field of the combustor 30. Fuel is injected radially outward into the swirling air stream downstream from the main swirler 102 allowing for thorough mixing within the main mixer cavity 92 upstream from its exit. This swirling mixture enters the combustor chamber 32 where is burned completely.

Figure 5:
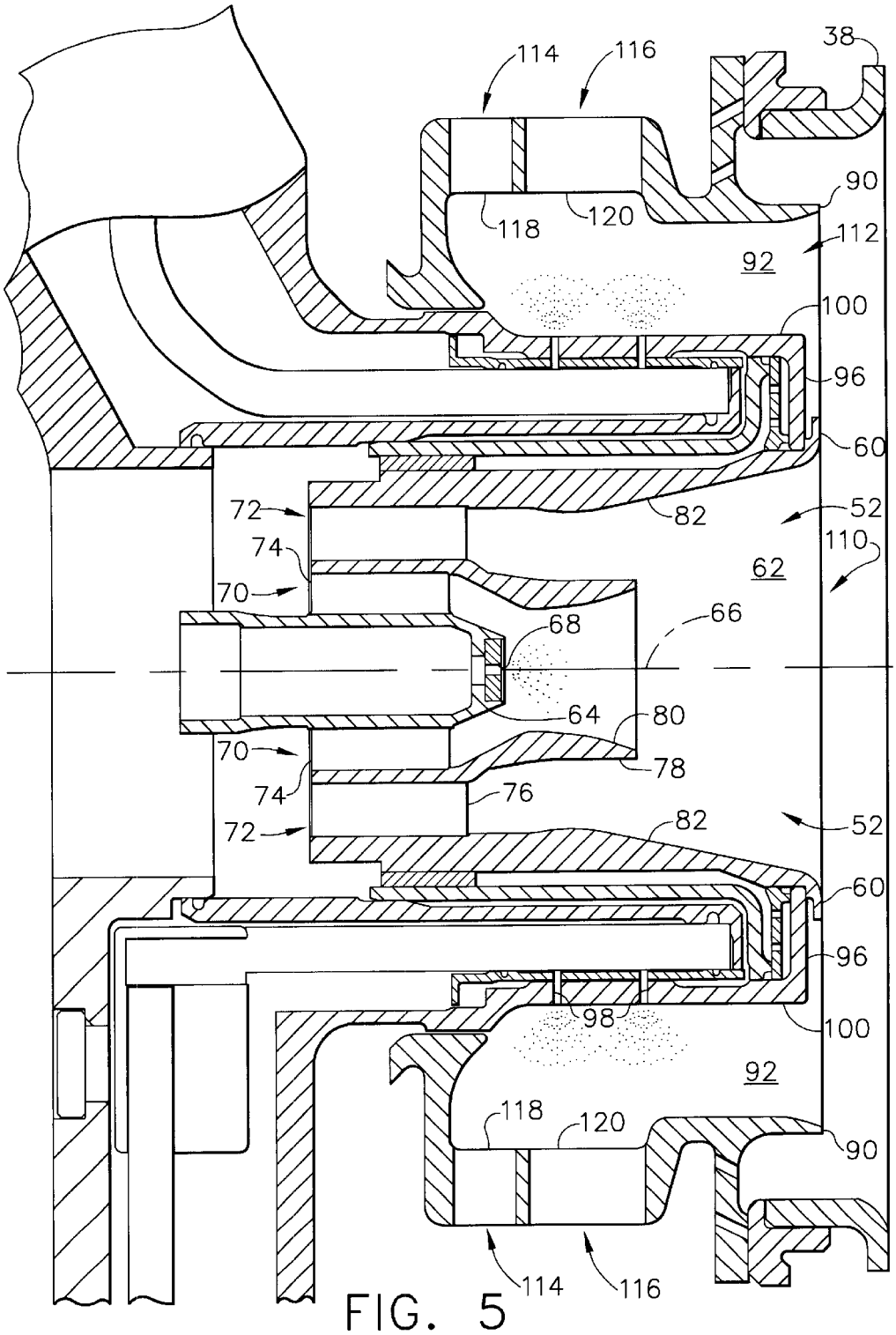
FIG. 5 is a vertical cross section of a mixer assembly of a second embodiment of the present invention.

A second embodiment of the mixer 110 shown in FIG. 5 includes a main mixer 112 having two swirlers, generally designated by 114, 116, positioned upstream from the plurality of fuel injection ports 96. Each of the swirlers 114, 116 has a plurality of vanes 118, 120, respectively, for swirling air traveling through the respective swirler to mix the air and the droplets of fuel dispensed by the ports 96 in the manifold 94 to form a fuel-air mixture selected for optimal burning during high power settings of the engine. Although the swirlers 114, 116 may have different numbers of vanes 118, 120 without departing from the scope of the present invention, in one embodiment the forward main swirler has 32 vanes and the rearward main swirler has 32 vanes. Both swirlers 114, 116 are radial swirlers and each of the vanes 118, 120 is a radially skewed vane. As will be appreciated by those skilled in the art, the swirlers 114, 116 may be configured alternatively, to swirl air in the same direction or in opposite directions. However, counter-rotating swirlers 114, 116 provide increased turbulence and mixing within the main mixer cavity 92 which results in improved main mixer fuel-air pre-mixing and reduced NOx emissions. As the mixer of the second embodiment is identical to the mixer 50 of the first embodiment in all other respects, it will not be described in further detail.

In operation, only the pilot mixer is fueled during starting and low power conditions where stability and low CO/HC emissions are critical. The main mixer is fueled during high power operation including takeoff, climb and cruise conditions. The fuel split between the pilot and main mixers is selected to provide good efficiency and low NOx emissions as is well understood by those skilled in the art.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

What is claimed is:

1. A mixer assembly for use in a combustion chamber of a gas turbine engine, said assembly comprising:

a pilot mixer including an annular pilot housing having a hollow interior, a pilot fuel nozzle mounted in the housing and adapted for dispensing droplets of fuel to the hollow interior of the pilot housing, and a plurality of concentrically mounted axial swirlers positioned upstream from the pilot fuel nozzle, each of said plurality of swirlers having a plurality of vanes for swirling air traveling through the respective swirler to mix air and the droplets of fuel dispensed by the pilot fuel nozzle; and a main mixer including a main housing surrounding the pilot housing and defining an annular cavity, a plurality of fuel injection ports for introducing fuel into the cavity, and a swirler surrounding the pilot mixer and positioned upstream from the plurality of fuel injection ports having a plurality of vanes for swirling air traveling through the swirler to mix air and the droplets of fuel dispensed by the fuel injection ports.

2. A mixer assembly as set forth in claim 1 wherein the main mixer swirler is a radial swirler.

3. A mixer assembly as set forth in claim 1 further comprising a barrier positioned between at least two of said plurality of swirlers in the pilot mixer, said barrier having a converging inner surface downstream from said swirlers.

4. A mixer assembly as set forth in claim 3 wherein the barrier has a diverging inner surface downstream from said converging surface.

5. A mixer assembly as set forth in claim 1 wherein the pilot housing obstructs a clear line of sight between the pilot mixer fuel nozzle and the main housing.

6. A mixer assembly as set forth in claim 1 wherein said main mixer swirler is a first swirler and the main mixer includes a second swirler positioned upstream from said plurality of fuel injection ports, said second swirler having a plurality of vanes for swirling air traveling through said second swirler to mix air and the droplets of fuel dispensed by said plurality of fuel injection ports.

7. A mixer assembly as set forth in claim 1 in combination with a combustion chamber comprising:

an annular outer liner defining an outer boundary of the combustion chamber;

an annular inner liner mounted inside the outer liner and defining an inner boundary of the combustion chamber; and an annular dome mounted upstream from the outer liner and the inner liner and defining an upstream end of the combustion chamber, said mixer assembly being mounted on the dome for delivering a mixture of fuel and air to the combustion chamber.

8. A mixer assembly for use in a combustion chamber of a gas turbine engine, said assembly comprising;

a pilot mixer including an annular pilot housing having a hollow interior, a pilot fuel nozzle mounted in the housing and adapted for dispensing droplets of fuel to the hollow interior of the pilot housing, and a plurality of concentrically mounted axial swirlers positioned upstream from the pilot fuel nozzle, each of said plurality of swirlers having a plurality of vanes for swirling air traveling through the respective swirler to mix air and the droplets of fuel dispensed by the pilot nozzle;

a main mixer including a main housing, surrounding the pilot housing and defining an annular cavity, a plurality of fuel injection ports for introducing fuel into the cavity, and a swirler positioned upstream from the plurality of fuel injection ports having a plurality of vanes for swirling air traveling through the swirler to mix air and the droplets of fuel dispensed by the fuel injection ports; and a fuel manifold positioned between the pilot mixer and the main mixer, said plurality of fuel injection ports for introducing fuel into the main mixer cavity being positioned on an exterior surface of the fuel manifold.

9. A mixer assembly as set forth in claim 8 wherein the main mixer swirler is a radial swirler.

10. A mixer assembly as set forth in claim 8 further comprising a barrier positioned between at least two of said plurality of swirlers in the pilot mixer, said barrier having a converging inner surface downstream from said swirlers.

11. A mixer assembly as set forth in claim 10 wherein the barrier has a diverging inner surface downstream from said converging surface.

12. A mixer assembly as set forth in claim 8 wherein the pilot housing obstructs a clear line of sight between the pilot mixer fuel nozzle and the main housing.

13. A mixer assembly, as set forth in claim 8 wherein said main mixer swirler is a first swirler and the main mixer includes a second swirler positioned upstream from said plurality of fuel injection ports, said second swirler having a plurality of vanes for swirling air traveling through said second swirler to mix air and the droplets a fuel dispensed by said plurality of fuel injection ports.

14. A mixer assembly as set forth in claim 8 in combination with a combustion chamber comprising:

an annular outer liner defining an outer boundary of the combustion chamber;

an annular inner liner mounted inside the outer liner and defining an inner boundary of the combustion chamber; and an annular dome mounted upstream from the outer liner and the inner liner and defining an upstream end of the combustion chamber, said mixer assembly being mounted on the dome for delivering a mixture of fuel and air to the combustion chamber.

* * * * *